US009157675B2

(12) United States Patent
Howington et al.

(10) Patent No.: US 9,157,675 B2
(45) Date of Patent: Oct. 13, 2015

(54) INSULATED CASE CONSTRUCTION

(75) Inventors: Larry C. Howington, Chesterfield, VA (US); Larry W. Eget, Powhatan, VA (US)

(73) Assignee: Hill Phoenix, Inc., Conyers, GA (US)

( * ) Notice: Subject to any disclaimer, the term of this patent is extended or adjusted under 35 U.S.C. 154(b) by 469 days.

(21) Appl. No.: 13/101,047

(22) Filed: May 4, 2011

(65) Prior Publication Data

US 2011/0304253 A1 Dec. 15, 2011

Related U.S. Application Data

(60) Provisional application No. 61/353,050, filed on Jun. 9, 2010.

(51) Int. Cl.

| | |
|---|---|
| ***F25D 27/00*** | (2006.01) |
| ***F25D 21/04*** | (2006.01) |
| *A47F 3/04* | (2006.01) |
| *A47F 11/10* | (2006.01) |
| *F25D 23/02* | (2006.01) |

(52) U.S. Cl.

CPC ..... *F25D 21/04* (2013.01); *F25D 27/00* (2013.01); *A47F 3/0426* (2013.01); *A47F 11/10* (2013.01); *F25D 23/02* (2013.01)

(58) Field of Classification Search

USPC ..... 312/400, 401, 116, 407; 62/246, 465, 62/248; 52/656.8, 309.9, 834, 836, 843; 362/92, 125, 133

See application file for complete search history.

(56) References Cited

U.S. PATENT DOCUMENTS

| | | | | |
|---|---|---|---|---|
| 1,347,161 | A * | 7/1920 | Hornung | 312/116 |
| 2,651,074 | A | 9/1953 | Slopa et al. | |
| 3,061,871 | A | 11/1962 | Swanson | |
| 3,076,163 | A | 1/1963 | Nodge | |
| 3,089,202 | A | 5/1963 | Pulaski | |
| 3,091,819 | A | 6/1963 | Wheeler et al. | |
| 3,156,019 | A | 11/1964 | Dawley | |
| 3,177,989 | A | 4/1965 | Di Chiaro | |
| 3,254,452 | A * | 6/1966 | Costantini et al. | 49/386 |

(Continued)

FOREIGN PATENT DOCUMENTS

| | | |
|---|---|---|
| EP | 0 886 70 | 9/1983 |
| WO | WO 2009/100940 A2 | 8/2009 |

OTHER PUBLICATIONS

U.S. Appl. No. 13/086,320, filed Apr. 13, 2011, Stubblefield.

(Continued)

*Primary Examiner* — Ismael Negron
(74) *Attorney, Agent, or Firm* — Foley & Lardner LLP

(57) ABSTRACT

A temperature controlled display device includes a body portion at least partially defining an interior space for storing refrigerated or frozen objects therein. The display device includes a frame coupled to the body portion, where the frame defines at least one opening and a door is coupled thereto for movement between a closed position and open position to permit access to the interior space through the opening. The frame includes two parallel vertical members and two parallel horizontal members. A lighting device is coupled to an interior surface of at least one of the vertical members, to illuminate the interior space. A thermally conductive member is disposed within the vertical member and extends at least partially along the length of the vertical members to transfer heat from the lighting device to an exterior surface of the vertical member.

14 Claims, 10 Drawing Sheets

(56) References Cited

U.S. PATENT DOCUMENTS

| | | | | | |
|---|---|---|---|---|---|
| 3,339,225 | A | | 9/1967 | Summer | |
| 3,403,525 | A | | 10/1968 | Beckwith et al. | |
| 3,518,716 | A | | 7/1970 | Larson | |
| 3,629,972 | A | | 12/1971 | Rehberg et al. | |
| 3,673,735 | A | | 7/1972 | Winsler et al. | |
| 3,690,118 | A | | 9/1972 | Rainwater | |
| 3,729,603 | A | | 4/1973 | Foltz | |
| 3,771,323 | A | | 11/1973 | Simons et al. | |
| 3,933,006 | A | | 1/1976 | South | |
| 4,034,572 | A | | 7/1977 | Morris et al. | |
| 4,067,628 | A | * | 1/1978 | Sherburn | 312/407 |
| 4,127,765 | A | | 11/1978 | Heaney | |
| 4,145,844 | A | | 3/1979 | Kaspar | |
| 4,215,449 | A | | 8/1980 | Loikitz | |
| 4,458,501 | A | | 7/1984 | Kooy | |
| 4,543,800 | A | | 10/1985 | Mawby et al. | |
| 4,548,049 | A | | 10/1985 | Rajgopal | |
| 4,578,902 | A | | 4/1986 | Niekrasz et al. | |
| 4,592,209 | A | | 6/1986 | Casanova et al. | |
| 4,671,582 | A | | 6/1987 | Stromquist et al. | |
| 4,696,078 | A | | 9/1987 | Stromquist | |
| 4,753,043 | A | | 6/1988 | Bockwinkel | |
| 4,905,347 | A | | 3/1990 | Wroth | |
| 4,953,363 | A | | 9/1990 | Primozic | |
| 5,011,240 | A | | 4/1991 | Kelley et al. | |
| 5,054,163 | A | | 10/1991 | Sterling et al. | |
| 5,113,628 | A | | 5/1992 | Richardson et al. | |
| 5,174,640 | A | * | 12/1992 | Kuwahara et al. | 312/407 |
| 5,228,240 | A | | 7/1993 | Barroero et al. | |
| 5,301,092 | A | * | 4/1994 | Santosuosso et al. | 362/125 |
| 5,321,870 | A | | 6/1994 | Wada et al. | |
| 5,333,355 | A | | 8/1994 | Beswick et al. | |
| 5,363,611 | A | | 11/1994 | Richardson et al. | |
| 5,454,471 | A | | 10/1995 | Norvell | |
| RE35,149 | E | | 1/1996 | Richardson et al. | |
| RE35,392 | E | | 12/1996 | Richardson et al. | |
| 5,636,484 | A | | 6/1997 | DeBlock | |
| 5,645,330 | A | * | 7/1997 | Artwohl et al. | 312/116 |
| 5,758,512 | A | | 6/1998 | Peterson et al. | |
| 5,787,724 | A | | 8/1998 | Pohl et al. | |
| 5,895,111 | A | * | 4/1999 | Santosuosso et al. | 362/125 |
| 5,941,619 | A | | 8/1999 | Stieben et al. | |
| 5,946,933 | A | | 9/1999 | Clarke et al. | |
| 6,029,411 | A | | 2/2000 | Richardson | |
| 6,138,341 | A | | 10/2000 | Barroero et al. | |
| 6,144,017 | A | | 11/2000 | Millett et al. | |
| 6,148,563 | A | | 11/2000 | Roche et al. | |
| 6,209,265 | B1 | | 4/2001 | Banicevic et al. | |
| 6,345,693 | B1 | | 2/2002 | Yeo et al. | |
| 6,393,768 | B1 | | 5/2002 | Roche et al. | |
| 6,401,399 | B1 | | 6/2002 | Roche et al. | |
| 6,406,108 | B1 | | 6/2002 | Upton et al. | |
| 6,578,979 | B2 | * | 6/2003 | Truttmann-Battig | 362/92 |
| 6,606,833 | B2 | * | 8/2003 | Richardson et al. | 52/204.5 |
| 6,820,952 | B2 | | 11/2004 | Austin et al. | |
| 6,978,516 | B1 | | 12/2005 | Calderon et al. | |
| 7,213,375 | B2 | | 5/2007 | Morgan et al. | |
| 7,243,394 | B2 | | 7/2007 | Kao | |
| 7,244,058 | B2 | * | 7/2007 | DiPenti et al. | 362/547 |
| 7,246,470 | B2 | | 7/2007 | Beyrle | |
| 7,318,321 | B2 | | 1/2008 | Grassmuck et al. | |
| 7,434,950 | B2 | * | 10/2008 | Whitney | 362/92 |
| 7,513,637 | B2 | | 4/2009 | Kelly et al. | |
| 7,559,672 | B1 | * | 7/2009 | Parkyn et al. | 362/244 |
| 7,681,369 | B2 | | 3/2010 | Soltesiz et al. | |
| 7,681,409 | B2 | | 3/2010 | Alahyari et al. | |
| 7,744,252 | B2 | | 6/2010 | Maxik | |
| 7,752,822 | B2 | | 7/2010 | Minelli | |
| 7,766,497 | B2 | * | 8/2010 | Sommers et al. | 362/92 |
| 7,856,770 | B2 | | 12/2010 | Grassmuck et al. | |
| 7,870,704 | B2 | | 1/2011 | Riblier et al. | |
| 7,871,176 | B2 | | 1/2011 | Kelly et al. | |
| 7,891,154 | B2 | | 2/2011 | Cording | |
| 7,954,979 | B2 | * | 6/2011 | Sommers et al. | 362/217.01 |
| 8,038,312 | B2 | * | 10/2011 | Otsuki et al. | 362/125 |
| 8,057,061 | B2 | * | 11/2011 | Otsuki et al. | 362/125 |
| 8,117,865 | B2 | | 2/2012 | Allard et al. | |
| 2002/0051357 | A1 | * | 5/2002 | Truttmann-Battig | 362/92 |
| 2002/0062654 | A1 | | 5/2002 | Navarro | |
| 2004/0194388 | A1 | | 10/2004 | Roche et al. | |
| 2005/0217306 | A1 | | 10/2005 | Renaud | |
| 2006/0021368 | A1 | | 2/2006 | Jaffer et al. | |
| 2006/0059861 | A1 | | 3/2006 | Grassmuck et al. | |
| 2006/0103269 | A1 | | 5/2006 | Artwohl et al. | |
| 2006/0162361 | A1 | | 7/2006 | Roche et al. | |
| 2007/0022667 | A1 | | 2/2007 | Olofsson | |
| 2007/0159820 | A1 | * | 7/2007 | Crandell et al. | 362/249 |
| 2008/0007945 | A1 | * | 1/2008 | Kelly et al. | 362/218 |
| 2008/0042537 | A1 | | 2/2008 | Kim et al. | |
| 2008/0122324 | A1 | | 5/2008 | Bienick | |
| 2008/0158858 | A1 | * | 7/2008 | Madireddi et al. | 362/92 |
| 2008/0186695 | A1 | * | 8/2008 | Awai et al. | 362/92 |
| 2008/0186696 | A1 | * | 8/2008 | Awai et al. | 362/92 |
| 2008/0211359 | A1 | | 9/2008 | Borgstrom et al. | |
| 2008/0259593 | A1 | | 10/2008 | Reese | |
| 2009/0071088 | A1 | | 3/2009 | Viegas et al. | |
| 2009/0072679 | A1 | | 3/2009 | Avila et al. | |
| 2009/0108724 | A1 | | 4/2009 | Jang | |
| 2009/0151265 | A1 | | 6/2009 | Gillen | |
| 2009/0249811 | A1 | | 10/2009 | Shin | |
| 2009/0288343 | A1 | | 11/2009 | Romolo | |
| 2010/0062152 | A1 | | 3/2010 | Roche et al. | |
| 2010/0068398 | A1 | | 3/2010 | Roche et al. | |
| 2010/0119705 | A1 | | 5/2010 | Roche et al. | |
| 2010/0139036 | A1 | | 6/2010 | Romolo | |
| 2010/0189571 | A1 | | 7/2010 | Coonrod | |
| 2010/0192468 | A1 | | 8/2010 | Chubb et al. | |
| 2010/0205991 | A1 | | 8/2010 | Ernst et al. | |
| 2010/0214769 | A1 | * | 8/2010 | Bhargava et al. | 362/125 |
| 2011/0043089 | A1 | | 2/2011 | Chubb et al. | |
| 2011/0058357 | A1 | * | 3/2011 | Anderson | 362/125 |
| 2011/0100044 | A1 | | 5/2011 | Reichert et al. | |
| 2011/0126561 | A1 | | 6/2011 | Sunderland et al. | |

OTHER PUBLICATIONS

U.S. Appl. No. 13/103,680, filed May 9, 2011, Stubblefield.
U.S. Appl. No. 13/105,703, filed May 11, 2011, Howington et al.
U.S. Appl. No. 12/797,246, filed Jun. 9, 2010, Howington et al.
U.S. Appl. No. 61/353,100, filed Jun. 9, 2010, Howington et al.
U.S. Appl. No. 61/353,071, filed Jun. 9, 2010, Stubblefield.
U.S. Appl. No. 61/353,061, filed Jun. 9, 2010, Stubblefield.
U.S. Appl. No. 61/353,050, filed Jun. 9, 2010, Howington et al.

* cited by examiner

FIGURE 12
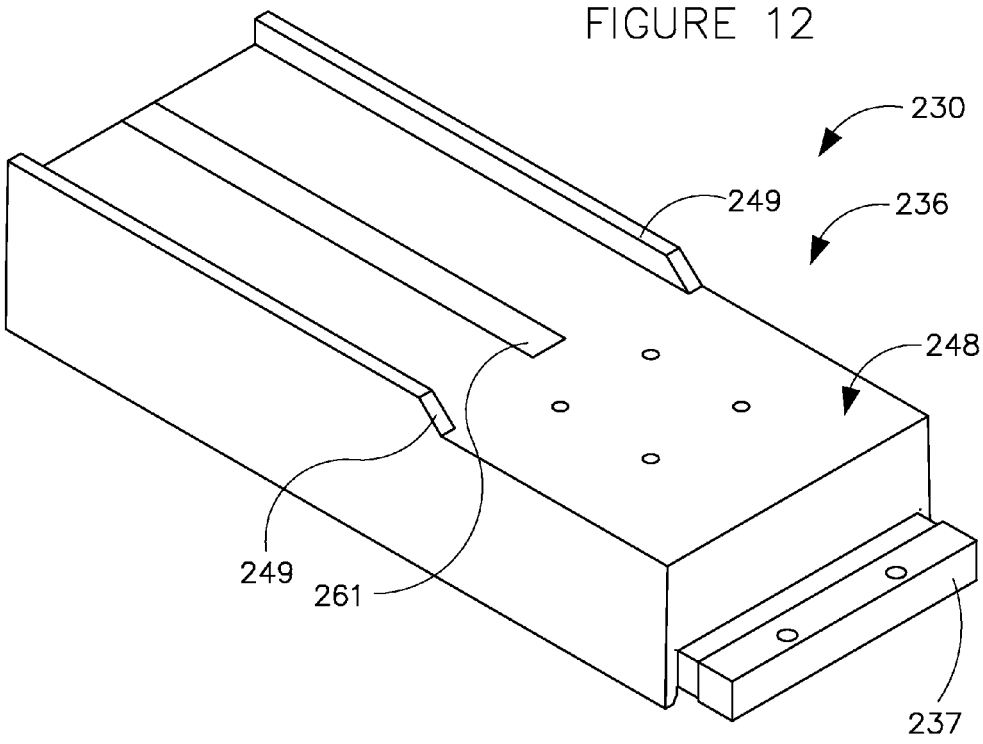
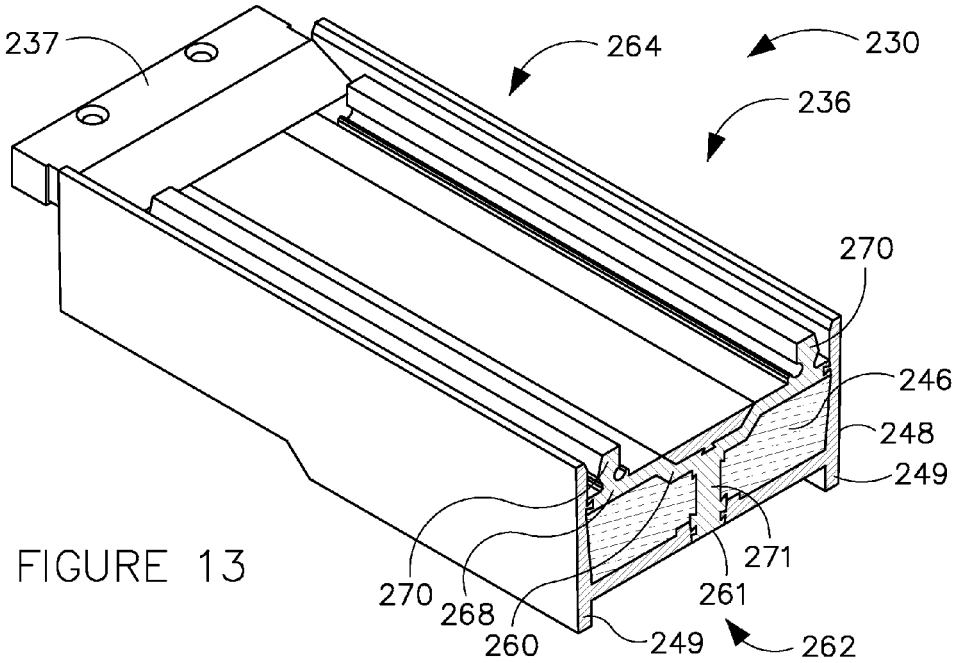
FIGURE 13

INSULATED CASE CONSTRUCTION

CROSS REFERENCE TO RELATED APPLICATIONS

The present Application claims the benefit of priority under 35 U.S.C. §119(e)(1) of U.S. Provisional Patent Application No. 61/353,050, titled "Refrigerated Case With Thermal Door Frame" and filed on Jun. 9, 2010, the disclosure of which is incorporated herein by reference in its entirety.

BACKGROUND

The present invention relates generally to the field of temperature controlled display devices (e.g. refrigerated cases, etc.) for storing and displaying refrigerated or frozen objects. More specifically, the present invention relates to a thermal door frame for refrigerated cases. More specifically still, the present invention relates to a door frame having improved insulation properties and/or a thermally conductive passageway to use waste heat from a lighting device to provide heat for anti-condensation purposes on an exterior surface of the door frame.

It is well known to provide a temperature controlled display device such as a refrigerator, freezer, refrigerated merchandiser, refrigerated display case, etc., that may be used in commercial, institutional, and residential applications for storing or displaying refrigerated or frozen objects. For example, it is known to provide self-service type refrigerated display cases or merchandisers having doors that are intended for operation by consumers to access refrigerated or frozen objects (e.g. food products and the like, etc.) within the temperature controlled interior space. However, such known temperature controlled display devices have a number of disadvantages. For example, the frames for such doors are typically made from metal extrusions that tend to be cooled by the interior space to the extent that condensation occurs on an exterior surface of the frame (e.g. adjacent to the door) that may lead to condensate puddle formation on the floor, or frost build-up that may prevent proper closing and sealing of the door to the frame, or may tend to cause the door and frame to freeze to one another. Such refrigerated cases are often provided with anti-condensation heaters in the form of electrical resistance heating elements mounted within the door frame extrusion to heat the exterior surface of the door frame to a temperature at or above the ambient dew point at the location of the refrigerated case (e.g. the ambient store environment, etc.). However, such known anti-condensation heaters typically consume a relatively large amount of electricity and reduce both the thermal performance and operating efficiency of the refrigerated case. By further way of example, such known temperature controlled display devices often include lighting devices within the temperature controlled interior space to illuminate the products stored therein. However, such lighting devices tend to emit waste heat that must usually be removed by the refrigeration system for the temperature controlled display device, thus placing a greater burden on the refrigeration system and further reducing the thermal performance and operating efficiency of the temperature controlled display device.

Accordingly, it would be desirable to provide a temperature controlled display device that overcomes these and/or other disadvantages.

SUMMARY

One embodiment of the invention relates to a temperature controlled display device having a body portion at least partially defining an interior space for storing refrigerated or frozen objects therein. The display device includes a frame coupled to the body portion, where the frame defines at least one opening and a door is coupled thereto for movement between a closed position and open position to permit access to the interior space through the opening. The frame includes two parallel vertical members and two parallel horizontal members. A lighting device is coupled to an interior surface of at least one of the vertical members, to illuminate the interior space. A thermally conductive member is disposed within the vertical member and extends at least partially along the length of the vertical members to transfer heat from the lighting device to an exterior surface of the vertical member.

Another embodiment of the invention relates to a temperature controlled display device having a body portion at least partially defining an interior space for storing refrigerated or frozen objects therein. The display device includes a frame coupled to the body portion, where the frame defines at least one opening and a door is coupled thereto for movement between a closed position and open position to permit access to the interior space through the opening. The frame includes at least two mullions, a top rail and a bottom rail. The mullions are formed as a composite structure having an interior insulating portion and a substantially rigid polymeric external shell portion. The upper rail and lower rail are formed as molded polymeric members and integrated into an insulation layer of the body portion. A first support member is disposed on the lower rail to at least partially support the weight of the door. A second support member is disposed on the upper rail to receive and adjustably position a top portion of the door.

Yet another embodiment of the invention relates to a temperature controlled display device having a body portion at least partially defining an interior space for storing refrigerated or frozen objects therein. The display device includes a frame coupled to the body portion. The frame defines at least one opening and has a door coupled thereto for movement between a closed position and open position to permit access to the interior space. The frame includes at least two mullions, a top rail and a bottom rail. The mullions are formed as a composite structure having an interior insulating portion and a substantially rigid polymeric external shell portion. The upper rail and lower rail are formed as molded polymeric members and are integrated into the body portion. A first support member is disposed on the lower rail to at least partially support the weight of the door and a second support member is disposed on the upper rail to receive and adjustably position a top portion of the door. LEDs are coupled to an interior surface of the mullions to illuminate the interior space. A thermally conductive member is disposed within the mullions and extends at least partially along the length of the mullion to transfer heat from the LEDs to an exterior surface of the mullion to provide anti-condensation heating to the external surface of the mullion.

BRIEF DESCRIPTION OF THE DRAWINGS

FIG. 12 is a schematic image of a partial front perspective view of the thermal door frame of FIG. 10 with the lens cover removed according to an exemplary embodiment.

FIG. 13 is a schematic image of a partial back perspective view of the thermal door frame of FIG. 10 with the lens cover removed according to an exemplary embodiment.

DETAILED DESCRIPTION

Referring to the FIGURES, various embodiments of a thermal door frame for a temperature-controlled display device (e.g. refrigerated case, etc) are disclosed. The thermal door frame is shown generally to include a composite structure having an interior insulating (e.g. foam, etc.) portion and a substantially rigid exterior surface (e.g. shell, etc.) to provide structural rigidity for use as a door frame, and superior thermal insulating performance. The thermal door frame is also shown to include a thermally conductive member that helps remove waste heat from a lighting device within the case and transfer the waste heat along a thermally conductive passageway (or pathway) provided by the member to an exterior surface of the frame to provide anti-condensation heating. The combination of the composite frame material and embedded thermally conductive member to remove waste heat from an internal lighting device to an exterior frame surface for anti-condensation heating is intended to improve the thermal performance and operational efficiency of the case, and to further eliminate or minimize the need for resistance-type electrical heaters within the frame for providing anti-condensation heating.

Figure 1:
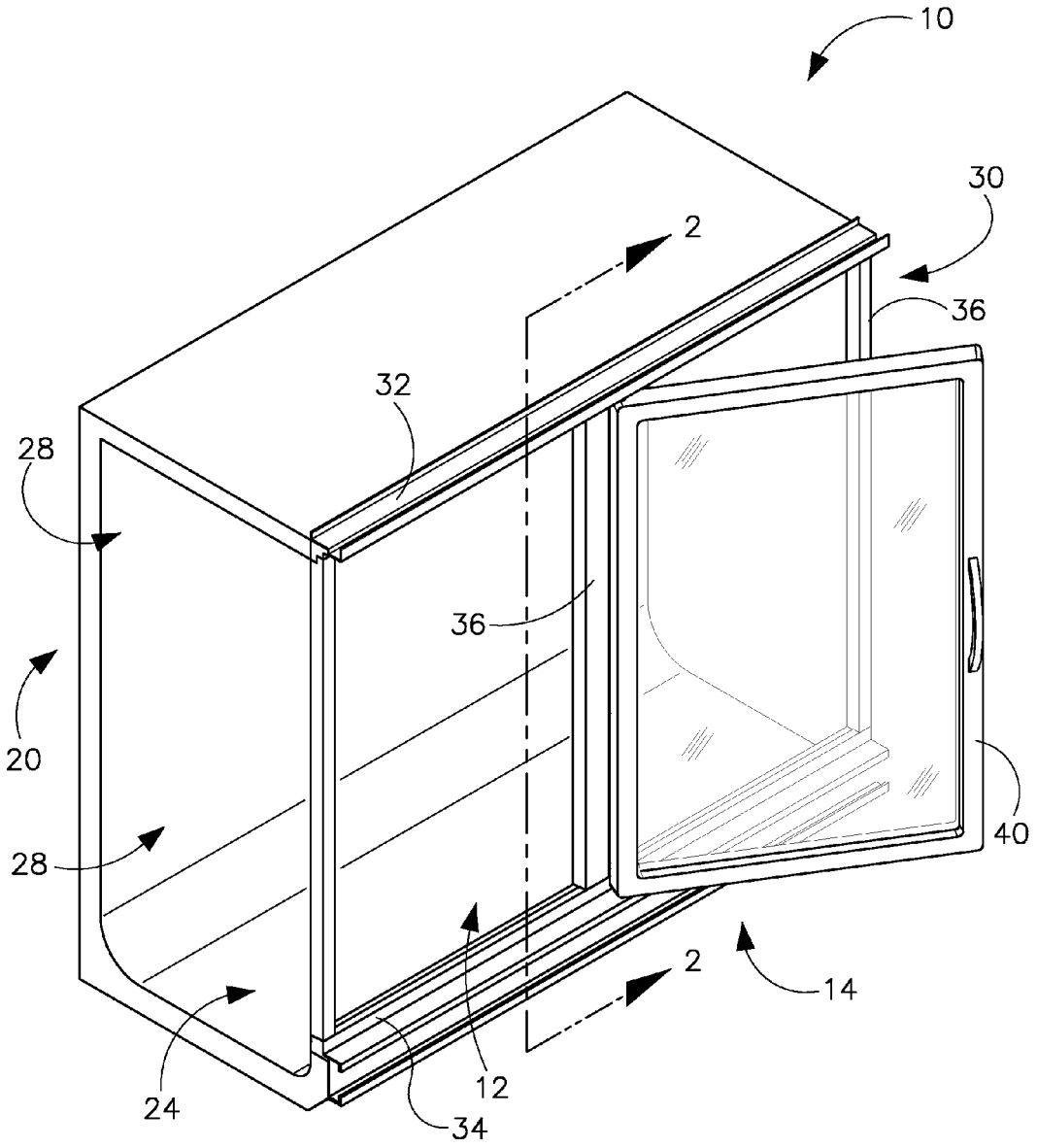
FIG. 1 is a schematic image of a perspective view of a temperature controlled display device having a thermal frame according to a first exemplary embodiment.

Referring more particularly to FIG. 1, a temperature controlled display device shown for example as a self-service type refrigerated case 10 having a thermal door frame 30 is shown according to a first exemplary embodiment. Refrigerated case 10 is shown to include a body portion 20 (e.g. tank, tub, etc.) having a top wall 11, bottom wall 24, back wall 26, and side walls 28 that at least partially define an interior space 12 for storing frozen or refrigerated products therein, and a generally open front 14. A thermal door frame 30 is coupled to the open front 14, the frame 30 including a substantially horizontal upper rail 32 and lower rail 34, and one or more substantially vertical mullions 36, that define one or more openings (shown by way of example as two end mullions and a center mullion defining two openings). Doors 40 are coupled (e.g. pivotally) to the frame 30 for movement between and open position and a closed position to permit access to the interior space 12 through the openings.

Figure 2:
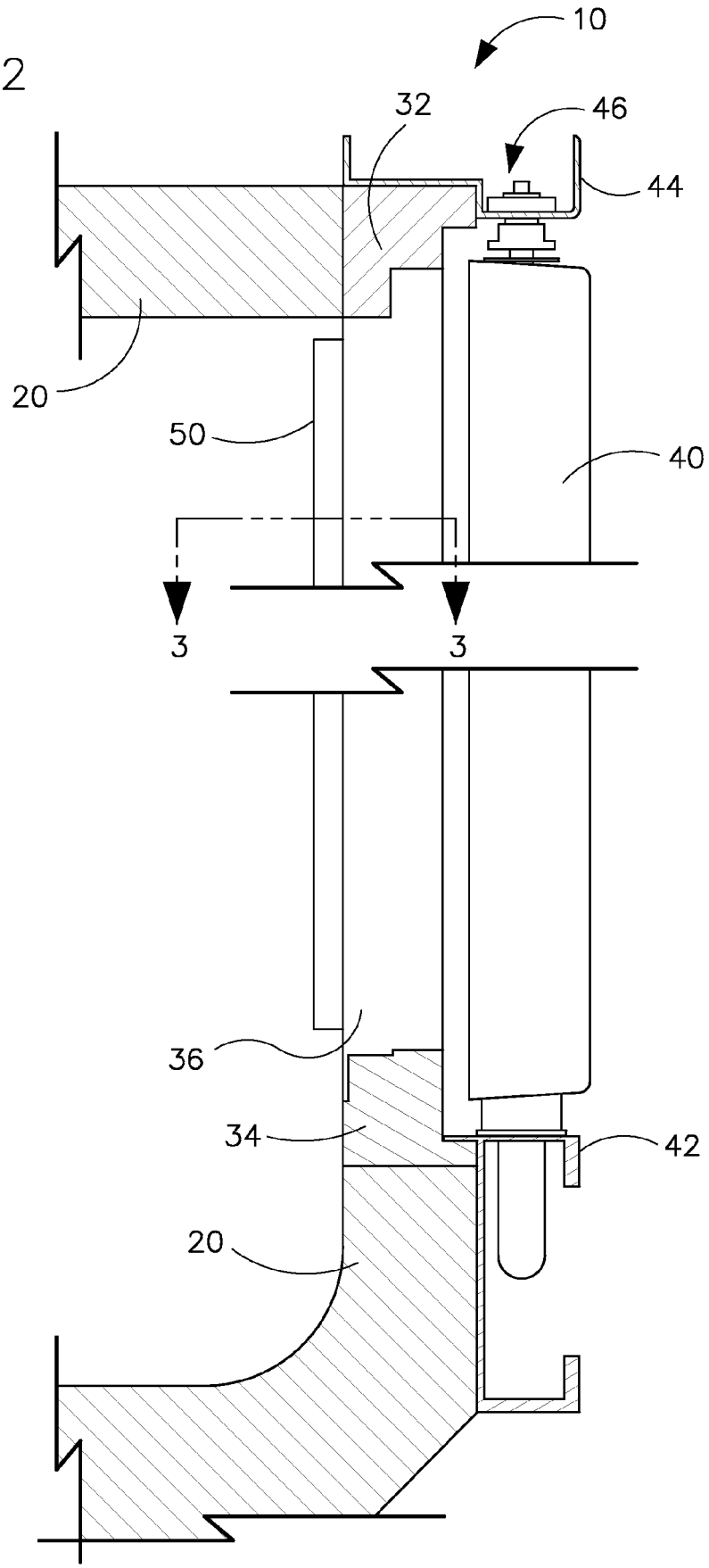
FIG. 2 is a schematic image of a cross-sectional view taken along lines 2-2 of FIG. 1 according to an exemplary embodiment.

Referring more particularly to FIG. 2, the upper rail 32 and lower rail 34 are formed as molded polymeric members in a suitable molding process (e.g. injection molding, etc.) from a suitable material (e.g. polyurethane, etc.). According to one embodiment, either or both of the lower rail 32 and the upper rail 34 may be internally filled with a suitable insulation material (e.g. polyurethane foam, etc.), and are integrated into the body portion 20 of the refrigerated case 10, such as by at least partially embedding or encapsulating them in an insulation "foaming" process. A first support member 42 is supported on (e.g. fit over, etc.) the lower rail 34 and is configured to support the weight of the door 40 and to house, contain or otherwise support other door-related hardware and/or devices. A second support member 44 is supported on (e.g. fit over, etc.) the upper rail 32 to receive and support a top portion of the door 40, and to house an adjustment mechanism 46 operable to permit the position of the door 40 to be adjusted within the frame 30 (e.g. for proper alignment, etc.). According to one embodiment, the first and second support members 42, 44 are formed from an extruded aluminum material.

Figure 3:
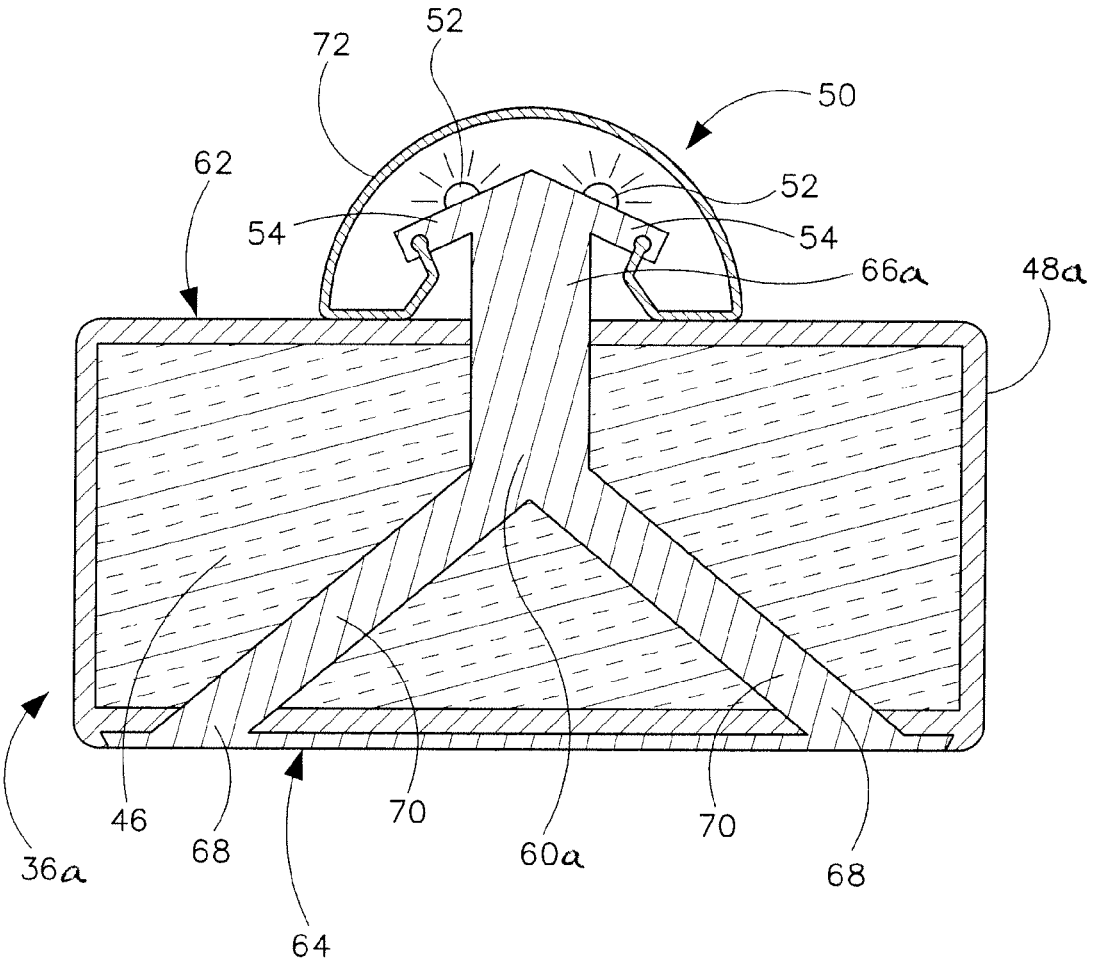
FIG. 3 is a schematic image of a cross-sectional view taken along lines 3-3 of FIG. 2 according to an exemplary embodiment.
Figure 4:
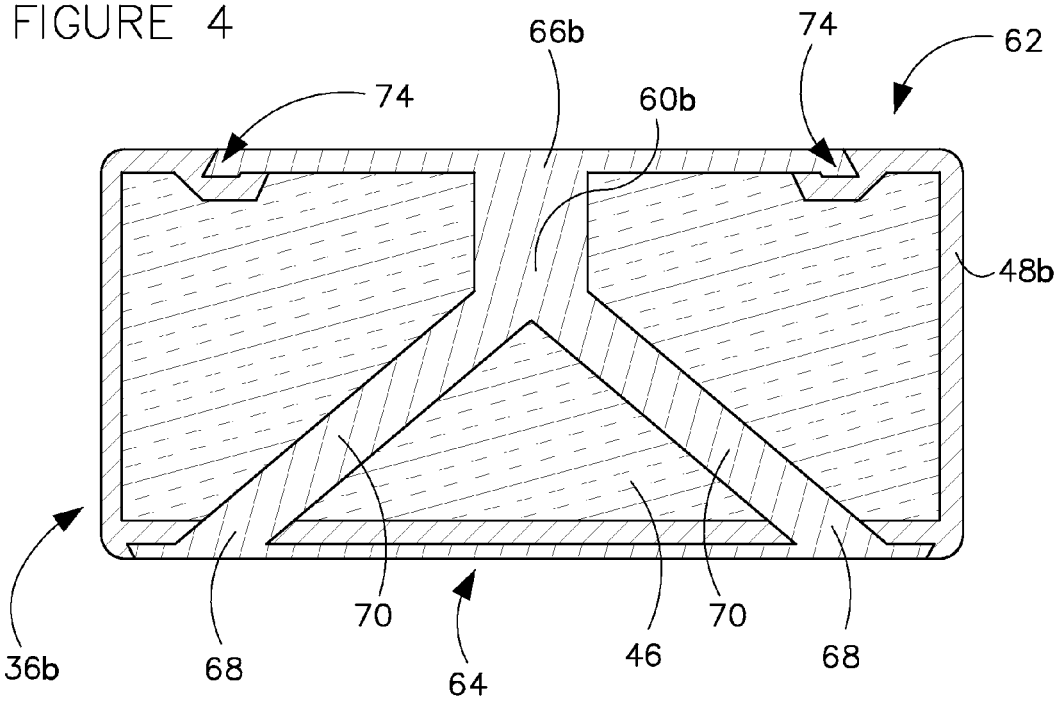
FIG. 4 is a schematic image of a cross-sectional view taken along lines 2-2 of FIG. 1 according to another exemplary embodiment.
Figure 5:
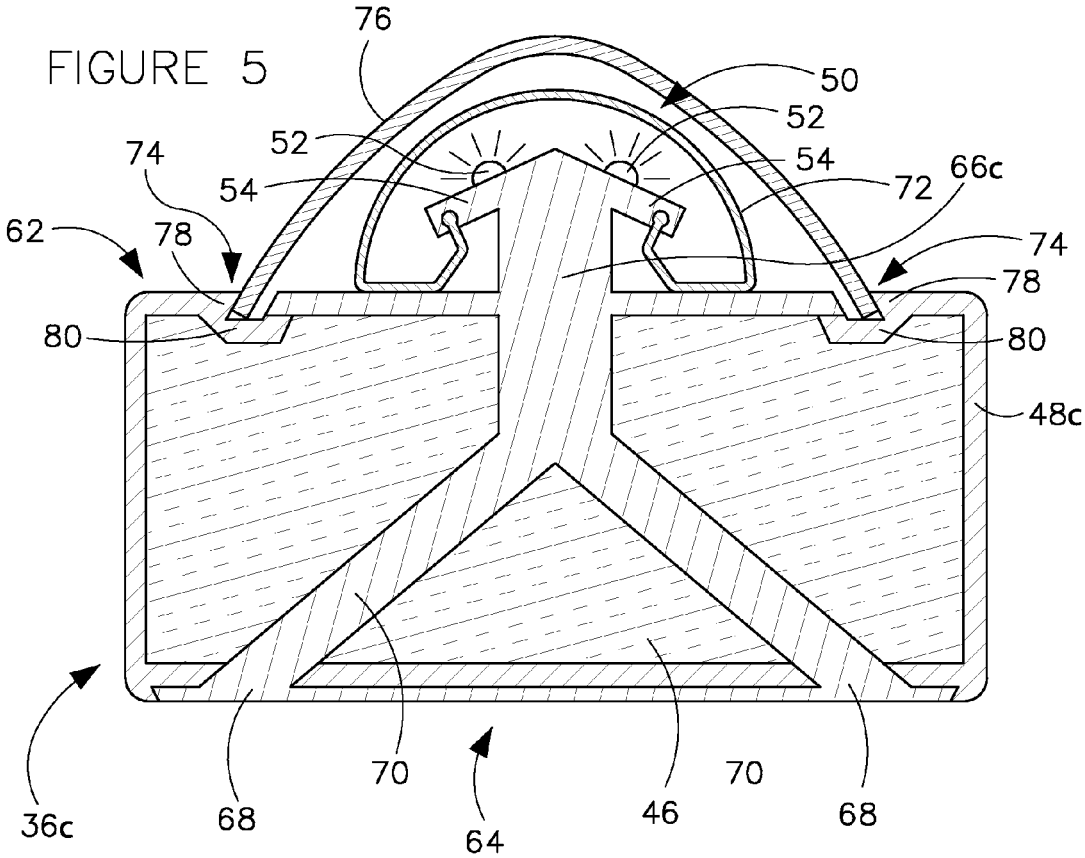
FIG. 5 is a schematic image of a cross-sectional view taken along lines 2-2 of FIG. 1 according to another exemplary embodiment.
Figure 6:
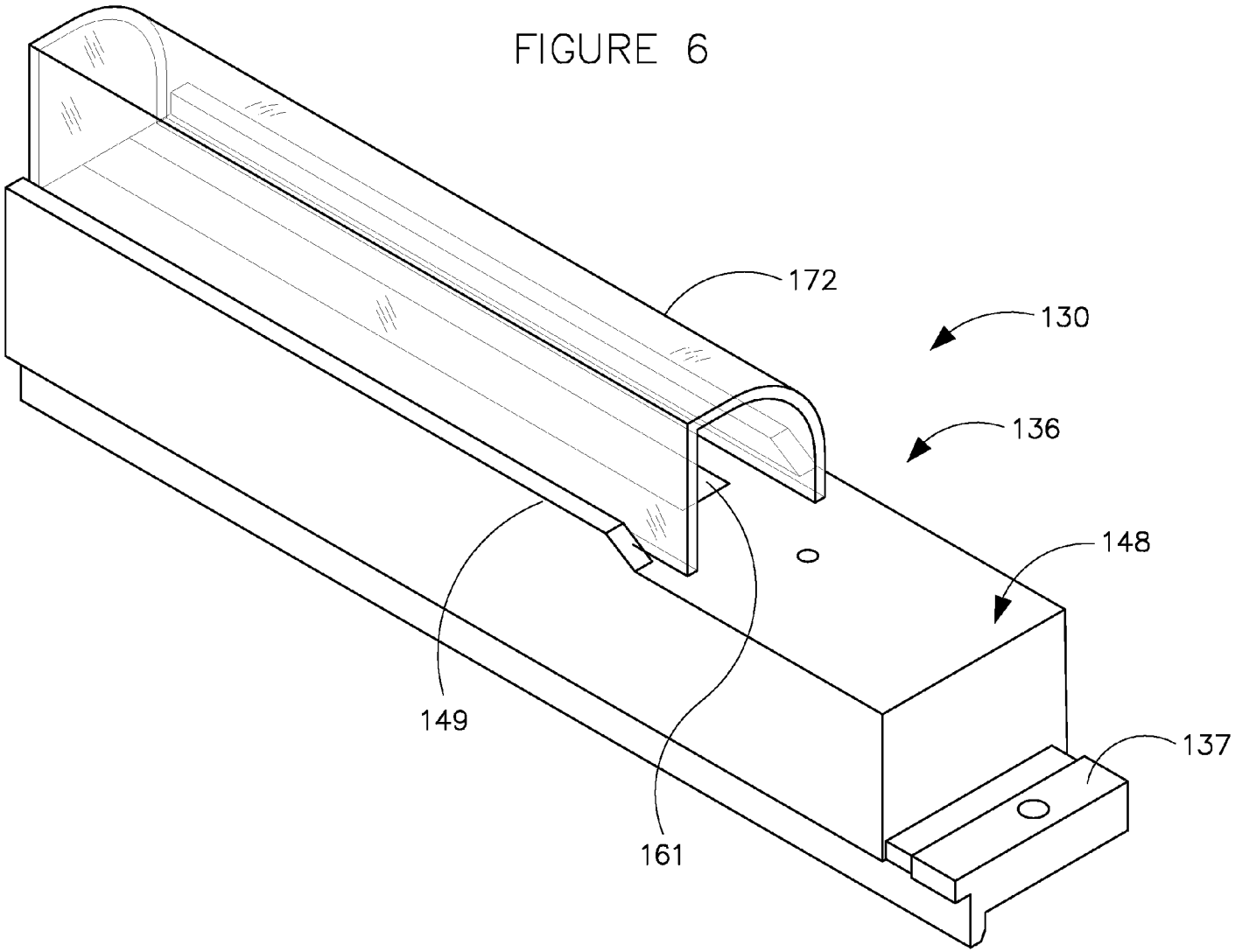
FIG. 6 is a schematic image of a partial front perspective view of a thermal frame for a temperature controlled display device according to a second exemplary embodiment.

Referring further to FIG. 2, the mullions 36*a* are coupled to the upper and lower rails 32, 34. As shown in FIGS. 3-5, the mullions 36*a* are formed as a composite structure having an internal insulating portion 46 comprising a material with a high R value and a substantially rigid external shell portion 48 that provides structural rigidity, easy cleanability, and support for mechanical fastening of other hardware or components. According to one embodiment, the internal insulating portion 46 is or may include a cyclopentane-blown rigid polyurethane foam, such as a material commercially available under the trademark Baytherm®, and the external shell portion 48 includes a polyurethane material, such as a material commercially available under the trademark Baydur®. The mullions 36*a* may be formed from any suitable process, such as reaction injection molding.

Referring further to FIGS. 2-5, a light source 50 is coupled to the mullions 36*a*, 36*b*, 36*c* for illuminating the interior space 12. According to one embodiment, the light source 50 includes a plurality of light emitting diodes (LEDs) 52 arranged as one or more strips, luminaires, etc. that includes a heat sink 54 for receiving heat associated with operation of the LEDs of the light source 50. Mullions 36*a*, 36*b*, 36*c* are also shown to include a thermally conductive member 60*a*, 60*b*, 60*c* formed within (e.g. integrally molded within, etc.) or otherwise embedded within the mullion 36*a*, 36*b*, 36*c* between an interior (e.g. refrigerated) side 62 and an exterior (e.g. ambient or door) side 64 of the mullion 36*a*, 36*b*, 36*c* to form a thermally conductive passageway (or pathway) that extends along all, or a portion, of the length of the mullion 36*a*, 36*b*, 36*c* (e.g. at least corresponding to the length of an LED strip, etc.). According to one embodiment, the thermally conductive member 60*a*, 60*b*, 60*c* may be formed from a conductive metal, such as aluminum, copper, or other suitable material. A first end 66*a*, 66*b*, 66*c* of the thermally conductive member 60*a*, 60*b*, 60*c* proximate the interior side 62 of the mullion 36*a*, 36*b*, 36*c* engages the heat sink 54 to provide a thermally conductive passageway (e.g. pathway, etc.) to direct waste heat from the light source 50 away from the refrigerated interior space 12 and toward the exterior side 64 of the mullion 36*a*, 36*b*, 36*c* to provide anti-condensation heating. The waste heat conducted to the exterior side 64 of the mullion 36*a*, 36*b*, 36*c* is intended to maintain the exterior surface 64 of the mullion 36*a*, 36*b*, 36*c* at a temperature that is at (or above) the local dew point of the ambient environment to prevent or minimize condensation and subsequent accumulation or puddling of condensate (e.g. on a floor beneath the case), and/or frosting or freezing of the surfaces of the mullion 36*a*, 36*b*, 36*c* and/or the adjacent door 40. The waste heat is intended to be sufficient to replace the need for electrical resistance heaters within the mullions, however such electrical resistance heaters may be included to provide supplemental anti-condensation heating on an as-needed basis, according to alternative embodiments.

Referring further to FIGS. 3-5, the shape of the thermally conductive member 60*a*, 60*b*, 60*c* is shown further according to an exemplary embodiment to be relatively wide at a second end 68 with branches or arms 70 that conduct heat toward the exterior side 64 of the mullion 36*a*, 36*b*, 36*c*, yet permit the placement of insulation material 46 therebetween to maintain a desired level of thermal insulation performance of the mullion 36*a*, 36*b*, 36*c*. The arms 70 of the thermally conductive member 60*a*, 60*b*, 60*c* converge toward the first end 66*a*, 66*b*, 66*c* near the interior side 62 of the mullion 36*a*, 36*b*, 36*c* to maximize a passageway for waste heat being conducted from the heat sink 54 and through the arms 70 to the exterior side 64 of the mullion 36*a*, 36*b*, 36*c*. However, the thermally conductive member may have any suitable shape for conducting (or otherwise transferring) waste heat away from the interior space 12 and toward the exterior side 64 of the mullion 36*a*, 36*b*, 36*c* to provide anti-condensation heating.

Referring further to FIGS. 4-5, the light source 50 is shown to be provided with a cover 72 (e.g. shield, lens, etc.) that is intended to help minimize convective heat transfer from the light source 50 to the refrigerated interior space 12, so that a relative maximum amount of heat from the light source 50 is available for conduction away from the interior space 12 and toward the exterior side 64 of the mullion 36 for anti-condensation heating. The edges of the cover 72 may be sealed to, or otherwise engage with, or attach to, the interior surface 62 of the mullion 36 to further minimize potential convective heat losses from the light source 50. According to other embodiments, additional covers 76 may be provided (e.g. in a stacked or concentric arrangement) in a similar manner as needed to obtain a desired thermal performance. According to one embodiment, the external shell portion 48 of the mullion 36 on the interior side 62 may be formed with suitable features such as connectors 74 (e.g. recesses, clips, latches, catches, ribs, pockets, etc.) that are configured to receive and secure the one or both of covers 72 and 76 in position over the light source 50 and to the mullion 36. As shown in FIG. 5, for example, the connectors 74 may include external projections 78 configured to releasably retain one or both of the covers 72 and 76, and the external shell portion 48 may also include internal projections 80 positioned substantially opposite the external projections 78 and projecting into the insulating portion 46 to engage with corresponding features of the insulating portion 46. Referring to FIG. 1, the refrigerated case 10 may also include air flow adjustment device(s) 16 (e.g. louvers, dampers, baffles, flow plates, etc.) for directing a cooling airflow (e.g. from a fan or the like) within the interior space 12 so that the airflow is directed away from the light source 50, in order to further minimize potential convective heat losses from the light source 50 to the interior space 12.

Figure 7:
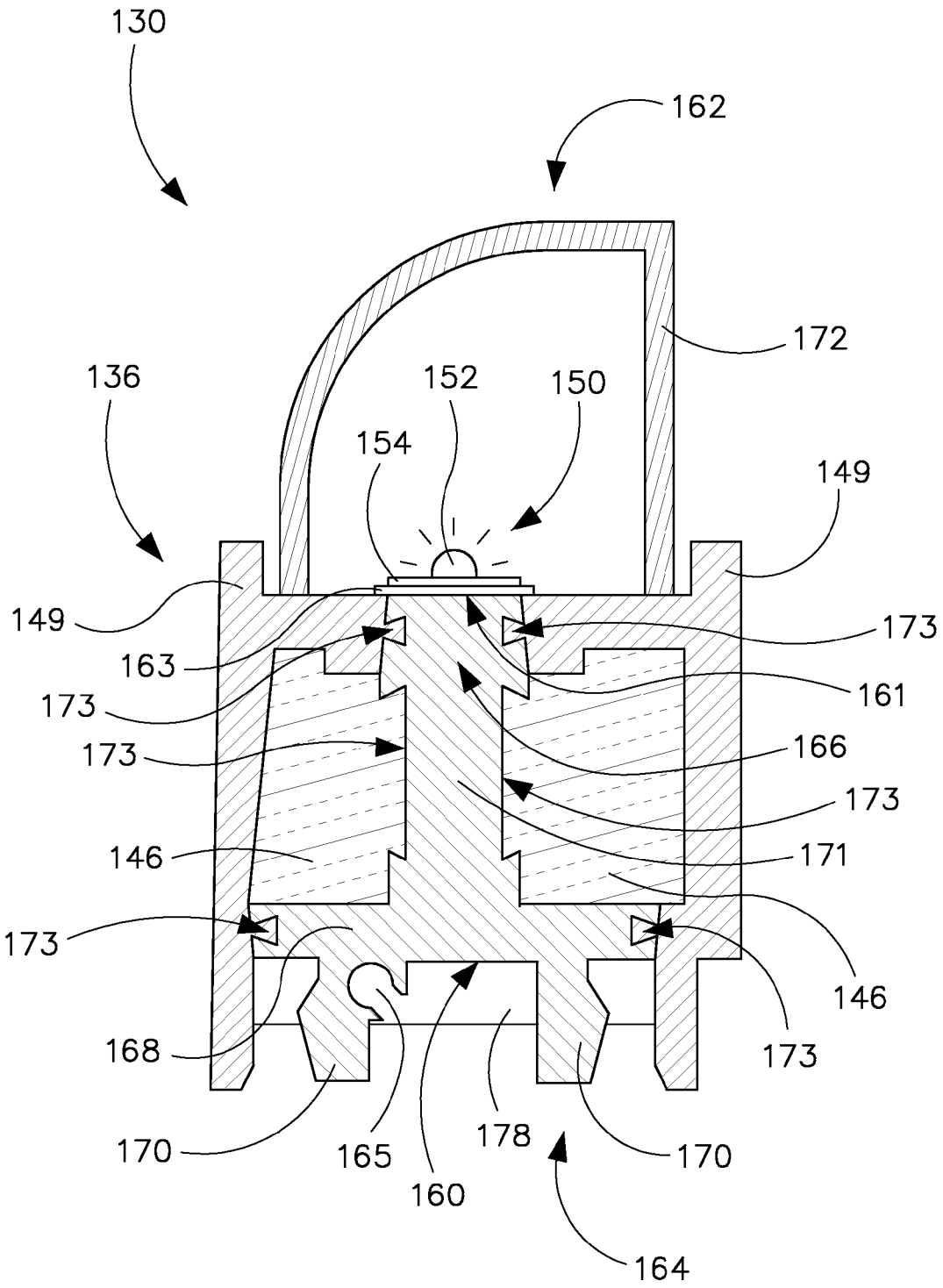
FIG. 7 is a schematic image of a cross-sectional view of the thermal door frame of FIG. 6 according to an exemplary embodiment.

Referring to FIGS. 6-9, components of a thermal door frame 130 are shown according to a second exemplary embodiment. The components of the thermal door frame 130 are intended for use in a temperature controlled display device, such as the type shown in FIG. 1. The components of the thermal door frame 130 according to the second exemplary embodiment include mullions 136, which are shown by way of example as single-width mullions, such as for use with a single door edge (e.g. at the ends of the display device, etc.), and may be coupled to the upper and lower rails of a temperature controlled display device using suitable connection brackets 137 and fasteners. As shown in FIG. 7, the mullions 136 are formed as a composite structure having an internal insulating portion 146 comprising a material with a high R value and a substantially rigid external shell portion 148 that provides structural rigidity, easy cleanability, and support for mechanical fastening of other hardware or components. According to one embodiment, the internal insulating portion 146 is or may include a cyclopentane-blown rigid polyurethane foam, such as a material commercially available under the trademark Baytherm®, and the external shell portion 148 includes a polyurethane material, such as a material commercially available under the trademark Baydur®. The mullions 136 may be formed from any suitable process, such as reaction injection molding.

Referring further to FIG. 7, a light source 150 is coupled to the mullions 136 for illuminating the interior space of the temperature controlled display device. According to one embodiment, the light source 150 includes a plurality of light emitting diodes (LEDs) 152 arranged as one or more strips, luminaires, etc. that includes a heat sink 154 for receiving heat associated with operation of the LEDs of the light source 150. Mullions 136 are also shown to include a thermally conductive member 160 formed within (e.g. integrally molded within, etc.) or otherwise embedded within the mullion 136 between an interior (e.g. refrigerated) side 162 and an exterior (e.g. ambient or door) side 164 of the mullion 136 to form a thermally conductive passageway (or pathway) that extends along all, or a portion, of the length of the mullion 136 (e.g. at least corresponding to the length of an LED strip, etc.). According to one embodiment, the thermally conductive member 160 may be formed from a conductive metal, such as aluminum, copper, or other suitable material. A first end 166 of the thermally conductive member 160 proximate the interior side 162 of the mullion 136 has a receiving surface 161 (shown as a substantially flat surface) configured to interchangeably receive and thermally engage any of a wide variety of different LED strips 150, in order to permit customizing the temperature controlled display device for different lighting requirements, without changing or reconfiguring the mullion. A thermal interface 163 may be provided in contact between the surface 161 and the heat sink 154 of the LED strip 150 to enhance the transfer of heat from the heat sink to the strip, and the LED strip may be interchangeably secured to the mullion using any suitable fastening device, such as clips, clamps, fasteners and the like. According to one embodiment, the thermal interface may be any suitable material such as a thermally conductive grease or the like. The heat sink 154, thermal interface 163, receiving surface 161 and thermally conductive member 160 provide a thermally conductive passageway (e.g. pathway, etc.) to direct waste heat from the light source 150 away from the refrigerated interior space and toward the exterior side 164 of the mullion 136 to reduce heat loading in the refrigerated space, and to provide anti-condensation heating. The waste heat conducted to the exterior side 164 of the mullion 136 is intended to maintain the exterior surface 164 of the mullion 136 at a temperature that is at (or above) the local dew point of the ambient environment to prevent or minimize condensation and subsequent accumulation or puddling of condensate (e.g. on a floor beneath the case), and/or frosting or freezing of the surfaces of the mullion 136 and/or the adjacent door. The waste heat is intended to be sufficient to replace the need for electrical resistance heaters within the mullions, however such electrical resistance heaters may be included to provide supplemental anti-condensation heating on an as-needed basis, according to alternative embodiments. For example, supplemental anti-condensation heaters (e.g. electrically-resistive wires, etc.) may be secured to the mullion 136 in a suitable structure, such as a groove 165 formed in the thermally conductive member 160.

Figure 8:
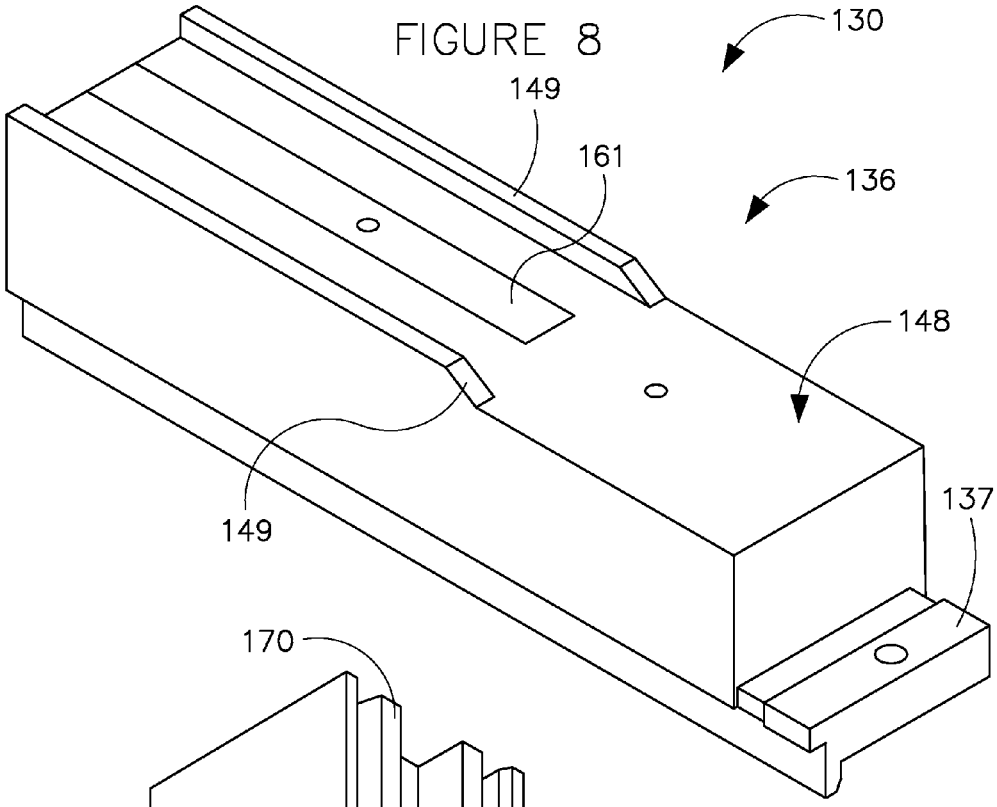
FIG. 8 is a schematic image of a partial front perspective view of the thermal door frame of FIG. 6 with the lens cover removed according to an exemplary embodiment.
Figure 9:
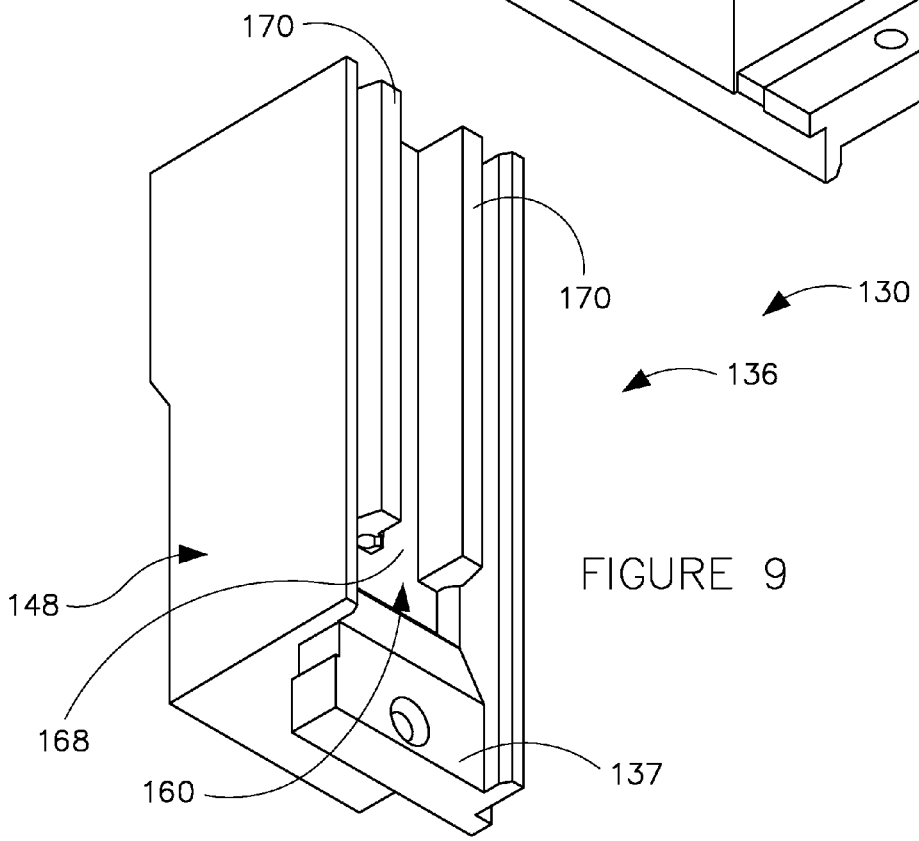
FIG. 9 is a schematic image of a partial back perspective view of the thermal door frame of FIG. 6 with the lens cover removed according to an exemplary embodiment.
Figure 10:
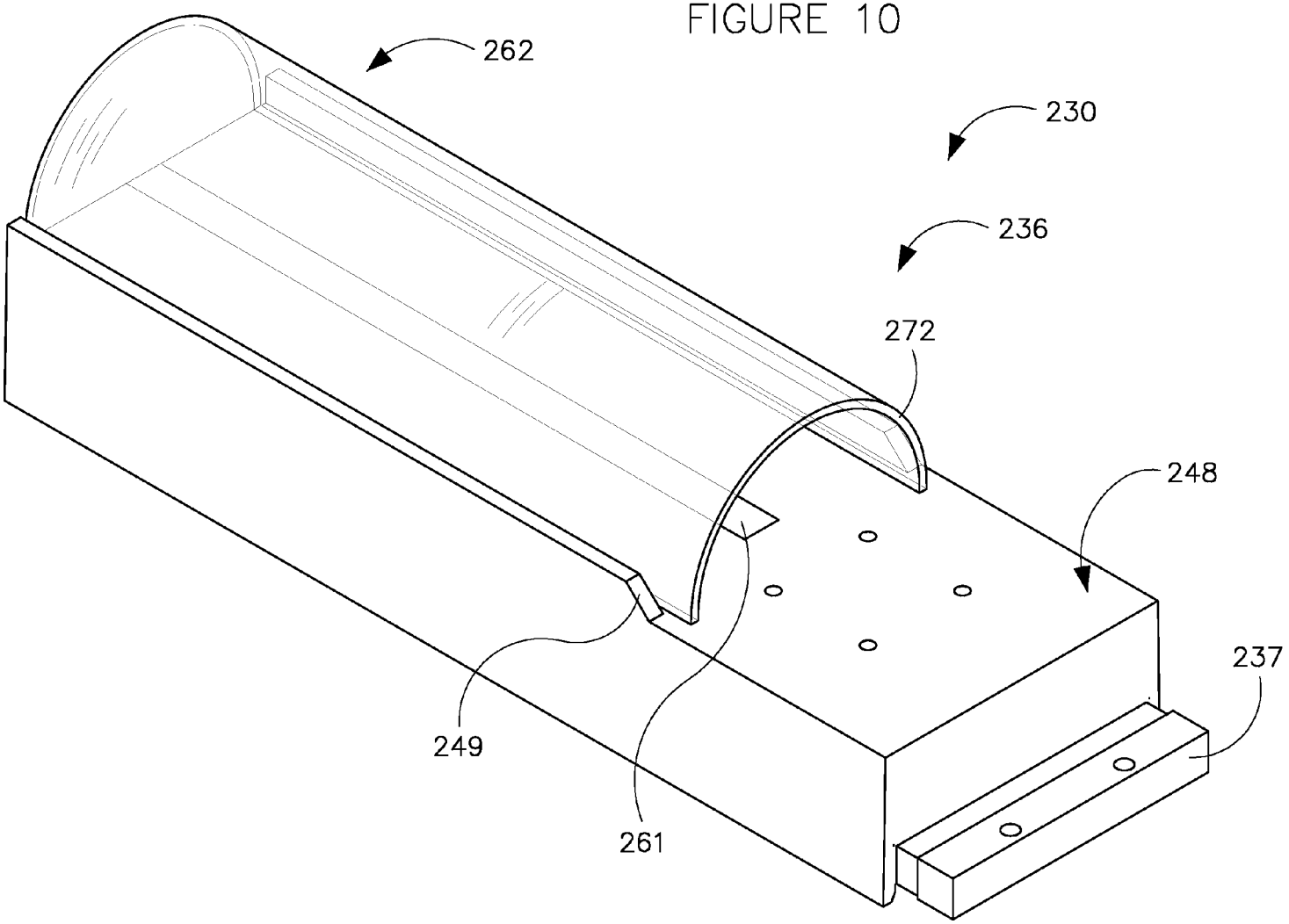
FIG. 10 is a schematic image of a partial front perspective view of a thermal frame for a temperature controlled display device according to a third exemplary embodiment.

Referring further to FIGS. 7-9, the shape of the thermally conductive member 160 is shown further according to an exemplary embodiment to include a relatively wide base portion 168 with feet 170 that conduct heat toward a striker plate 178 on the exterior side 164 of the mullion 136, such that the insulation material 146 is contained along an inside region to maintain a desired level of thermal insulation performance of the mullion 136. The thermally conductive member 160 is further shown to include a spine portion 171 that extends inwardly from the base portion 168 to the receiving surface 161 at the interior side 162 of the mullion 136 to maximize a passageway for waste heat being conducted from the heat sink 154 to the feet 170 and the exterior side 164 of the mullion 136. However, the thermally conductive member may have any suitable shape for conducting (or otherwise transferring) waste heat away from the refrigerated space and toward the exterior side 164 of the mullion 136 to provide anti-condensation heating. Spine portion 171 may also include structure configured to engage the thermal insulation 146 and the shell material 148. According to one embodiment, the structure is shown to include recesses 173 (e.g. slots, grooves, channels, etc.), which may be in the shape of dovetails, as shown, or any other suitable shape, for enhancing the connection between the thermally conductive member and the insulation and shell components of the mullion to enhance the durability and performance of the mullion.

Referring further to FIG. 7, the light source 150 is shown to be provided with a cover 172 (e.g. shield, lens, etc.) that is intended to help minimize convective heat transfer from the light source 150 to the refrigerated interior space, so that a relative maximum amount of heat from the light source 150 is available for conduction away from the refrigerated interior space and toward the exterior side 164 of the mullion 136 for anti-condensation heating. The edges of the cover 172 may be sealed to, or otherwise engage with, or attach to, projections 149 formed in the shell 148 that extend from the interior surface 162 of the mullion 136 to further minimize potential convective heat losses from the light source 150. According to other embodiments, additional covers may be provided (e.g. in a stacked or concentric arrangement) in a similar manner as needed to obtain a desired thermal performance. According to one embodiment, the projections 149 on external shell portion 148 of the mullion 136 may be formed with suitable features such as connectors (e.g. recesses, clips, latches, catches, ribs, pockets, etc.) that are configured to receive and secure the one or both ends of cover 172 in position over the light source 150 and to the mullion 136. As previously described with reference to FIG. 1, the refrigerated case may also include air flow adjustment device(s) (e.g. louvers, dampers, baffles, flow plates, etc.) for directing a cooling airflow (e.g. from a fan or the like) within the interior space so that the airflow is directed away from the light source 150, in order to further minimize potential convective heat losses from the light source 150 to the interior refrigerated space.

Figure 11:
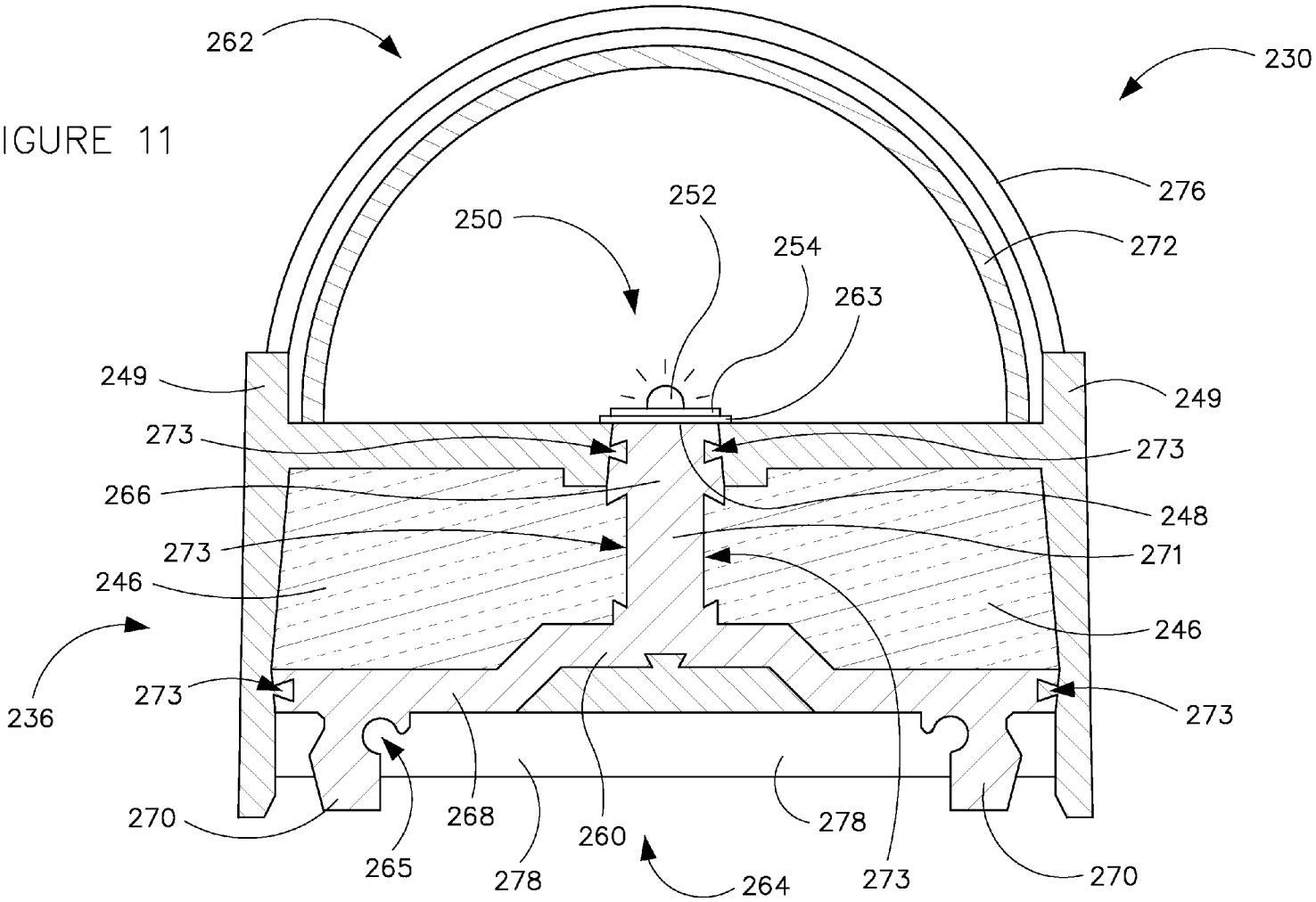
FIG. 11 is a schematic image of a cross-sectional view of the thermal door frame of FIG. 10 according to an exemplary embodiment.

Referring to FIGS. 10-13, components of a thermal door frame 230 are shown according to a third exemplary embodiment. The components of the thermal door frame 230 are intended for use in a temperature controlled display device, such as the type shown in FIG. 1. The components of the thermal door frame 230 according to the third exemplary embodiment include mullions 236, which are shown by way of example as double-width mullions, such as for use at a junction between two doors (e.g. between internal sections or compartments of the temperature controlled display device, etc.), and may be coupled to the upper and lower rails of a temperature controlled display device using suitable connection brackets 237 and fasteners. As shown in FIG. 11, the mullions 236 are formed as a composite structure having an internal insulating portion 246 comprising a material with a high R value and a substantially rigid external shell portion 248 that provides structural rigidity, easy cleanability, and support for mechanical fastening of other hardware or components. According to one embodiment, the internal insulating portion 246 is or may include a cyclopentane-blown rigid polyurethane foam, such as a material commercially available under the trademark Baytherm®, and the external shell portion 248 includes a polyurethane material, such as a material commercially available under the trademark Baydur®. The mullions 236 may be formed from any suitable process, such as reaction injection molding.

Referring further to FIG. 11, a light source 250 is coupled to the mullions 236 for illuminating the interior refrigerated space of the temperature controlled display device. According to one embodiment, the light source 250 includes a plurality of light emitting diodes (LEDs) 252 arranged as one or more strips, luminaires, etc. that includes a heat sink 254 for receiving heat associated with operation of the LEDs of the light source 250. Mullions 236 are also shown to include a thermally conductive member 260 formed within (e.g. integrally molded within, etc.) or otherwise embedded within the mullion 236 between an interior (e.g. refrigerated) side 262 and an exterior (e.g. ambient or door) side 264 of the mullion 236 to form a thermally conductive passageway (or pathway) that extends along all, or a portion, of the length of the mullion 236 (e.g. at least corresponding to the length of an LED strip, etc.). According to one embodiment, the thermally conductive member 260 may be formed from a conductive metal, such as aluminum, copper, or other suitable material. A first end 266 of the thermally conductive member 260 proximate the interior side 262 of the mullion 236 has a receiving surface 261 (shown as a substantially flat surface) configured to interchangeably receive and thermally engage any of a wide variety of different LED strips 250, in order to permit customizing the temperature controlled display device for different lighting requirements, without changing or reconfiguring the mullion. A thermal interface 263 may be provided in contact between the receiving surface 261 and the heat sink 254 of the LED strip 250 to enhance the transfer of heat from the heat sink to the strip, and the LED strip may be interchangeably secured to the mullion using any suitable fastening device, such as clips, clamps, fasteners and the like. According to one embodiment, the thermal interface 263 may be any suitable material such as a thermally conductive grease or the like. The heat sink 254, thermal interface 263, receiving surface 261 and thermally conductive member 260 provide a thermally conductive passageway (e.g. pathway, etc.) to direct waste heat from the light source 250 away from the refrigerated interior space and toward the exterior side 164 of the mullion 236 to reduce heat loading in the refrigerated space, and to provide anti-condensation heating. The waste heat conducted to the exterior side 264 of the mullion 236 is intended to maintain the exterior surface 264 of the mullion 236 at a temperature that is at (or above) the local dew point of the ambient environment to prevent or minimize condensation and subsequent accumulation or puddling of condensate (e.g. on a floor beneath the case), and/or frosting or freezing of the surfaces of the mullion 236 and/or the adjacent door. The waste heat is intended to be sufficient to replace the need for electrical resistance heaters within the mullions, however such electrical resistance heaters may be included to provide supplemental anti-condensation heating on an as-needed basis, according to alternative embodiments. For example, supplemental anti-condensation heaters (e.g. electrically-resistive wires, etc.) may be secured to the mullion 236 in a suitable structure, such as a groove 265 formed in the thermally conductive member 260.

Referring further to FIGS. 11-13, the shape of the thermally conductive member 260 is shown further according to an exemplary embodiment to include a relatively wide base portion 268 with feet 270 that conduct heat toward a striker plate 278 on the exterior side 264 of the mullion 236, such that the insulation material 246 is contained along an inside region to maintain a desired level of thermal insulation performance of the mullion 236. The thermally conductive member 260 is further shown to include a spine portion 271 that extends inwardly from the base portion 268 to the receiving surface 261 at the interior side 262 of the mullion 236 to maximize a passageway for waste heat being conducted from the heat sink 254 to the feet 270 and the exterior side 264 of the mullion 236. However, the thermally conductive member may have any suitable shape for conducting (or otherwise transferring) waste heat away from the refrigerated space and toward the exterior side 264 of the mullion 236 to provide anti-condensation heating. Spine portion 271 may also include structure configured to engage the thermal insulation 246 and the shell material 248. According to one embodiment, the structure is shown to include recesses 273 (e.g. slots, grooves, channels, etc.), which may be in the shape of dovetails, as shown, or any other suitable shape, for enhancing the connection between the thermally conductive member and the insulation and shell components of the mullion to enhance the durability and performance of the mullion.

Referring further to FIG. 11, the light source 250 is shown to be provided with a cover 272 (e.g. shield, lens, etc.) that is intended to help minimize convective heat transfer from the light source 250 to the refrigerated interior space, so that a relative maximum amount of heat from the light source 250 is available for conduction away from the refrigerated interior space and toward the exterior side 264 of the mullion 236 for anti-condensation heating. The edges of the cover 272 may be sealed to, or otherwise engage with, or attach to, projections 249 formed in the shell 248 that extend from the interior surface 262 of the mullion 236 to further minimize potential convective heat losses from the light source 250. According to other embodiments, additional covers may be provided (e.g. in a stacked or concentric arrangement) in a similar manner as needed to obtain a desired thermal performance. According to one embodiment, the projections 249 on external shell portion 248 of the mullion 236 may be formed with suitable features such as connectors (e.g. recesses, clips, latches, catches, ribs, pockets, etc.) that are configured to receive and secure the one or both ends of cover 272 in position over the light source 250 and to the mullion 236. According to an alternative embodiment, a second cover 276 may be provided (e.g. over cover 272) to further minimize heat loss to the interior refrigerated space. As previously described with reference to FIG. 1, the refrigerated case may also include air flow adjustment device(s) (e.g. louvers, dampers, baffles, flow plates, etc.) for directing a cooling airflow (e.g. from a fan or the like) within the interior space so that the airflow is directed away from the light source 250, in order to further minimize potential convective heat losses from the light source 250 to the interior refrigerated space.

According to any exemplary embodiment, a temperature controlled display device shown as a refrigerated case has a body portion at least partially defining an interior space for storing refrigerated or frozen objects therein. A frame is coupled to the body portion and defines at least one opening with a door coupled thereto for movement between a closed position and open position to permit access to the interior space. The frame includes at least two mullions, which are not intended as structural members of the case, but rather provide support for the light source and a sealing surface for the doors, a top rail and a bottom rail, where the mullions are formed as a composite member having an interior insulating portion and a substantially rigid polymeric external shell portion and the upper rail and lower rail are formed as molded polymeric members and integrated into the body portion of the case (e.g. by foaming). A light source having a plurality of LEDs is coupled to an interior surface of at least one of the mullions to illuminate the interior space. A thermally conductive member is embedded within the mullion to transfer heat generated from operation of the LEDs to an exterior surface of the mullion to provide anti-condensation heating to the exterior surface.

According to alternative embodiments, the upper and lower rails and mullions may be formed using any suitable process and from any suitable materials to provide the desired thermal and structural properties. Further, the thermally conductive member may be formed having other shapes or from other materials, or configured to draw waste heat from outer heat sources associated with the case (e.g. hot gas refrigerant, etc.). All such modifications are intended to be within the scope of this disclosure. Additionally, the mullions and upper and lower rails may be molded or otherwise formed as a single integrated unit having thermally conductive members embedded therein and configured attachment to the body portion of the case.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the refrigerated case with thermal door frame as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A temperature controlled display device having an insulated body portion at least partially defining an interior space for storing refrigerated or frozen objects therein, the display device comprising:

a frame coupled to the body portion, the frame defining at least one opening and having a door coupled thereto for movement between a closed position and open position to permit access to the interior space through the opening, the frame comprising:

a substantially horizontal lower rail integrated within a lower portion of the insulated body portion and including a plurality of lower receptacles;

a plurality of substantially parallel vertical mullions having a top end and a bottom end, each mullion formed as a composite structure having an interior insulating portion encapsulated within a substantially rigid external shell portion that includes internal projections extending along a length of the mullion and projecting into the insulating portion to engage with corresponding features of the insulating portion, the shell portion also including external projections positioned substantially opposite the internal projections and extending along a length of the mullion to releasably retain a cover; and a substantially horizontal upper rail coupled to an upper portion of the insulated body portion and including a plurality of upper receptacles;

wherein the bottom end of the mullions are received within the lower receptacles and the top end of the mullions are received within the upper receptacles.

2. The display device of claim 1 wherein the lower rail and the upper rail comprise hollow polymeric members that are substantially filled with an insulation material.

3. The display device of claim 1 wherein an insulation layer of the insulated body portion is foamed around the lower rail to at least partially encapsulate the lower rail within the body portion.

4. The display device of claim 1 wherein the lower receptacles have a first configuration engageable only with the lower end of the mullions, and the upper receptacles have a second configuration engageable only with the upper end of the mullions.

5. The display device of claim 1 wherein the plurality of mullions include one or more mullions with a first width and one or more mullions with a second width, wherein the second width is double the first width.

6. The display device of claim 1 wherein the plurality of mullions include two or more mullions.

7. The display device of claim 1 wherein the interior insulation portion of the mullions comprises a core of a polyurethane foam material and the external shell portion of the mullions comprise a non-foam layer of a polyurethane material.

8. The display device of claim 1 further comprising an upper support member coupled to the upper rail and a lower support member coupled to the lower rail, and wherein the upper and lower support members provide support for the door.

9. A temperature controlled display device having a body portion with an insulation layer at least partially defining an interior space for storing refrigerated or frozen objects therein, the display device comprising:

a frame coupled to the body portion, the frame defining at least one opening and having a door coupled thereto for movement between a closed position and open position to permit access to the interior space through the opening, the frame comprising:

a substantially horizontal lower rail integrated within a lower portion of the body portion and at least partially encapsulated within the insulation layer, and including a plurality of lower receptacles having a first configuration;

a substantially horizontal upper rail coupled to an upper portion of the insulated body portion and including a plurality of upper receptacles having a second configuration that is different from the first configuration;

a plurality of substantially parallel vertical mullions having a bottom end receivable only in the lower receptacle and a top end receivable only in the upper receptacle, each mullion formed as a composite structure having an interior insulating portion comprising a polyurethane foam material encapsulated within a substantially rigid external polyurethane shell portion, the shell portion including internal projections extending along a length of the mullion and projecting into the insulating portion to engage with corresponding features of the insulating portion, the shell portion also including external projections positioned substantially opposite the internal projections and extending along a length of the mullion to releasably retain a cover; and a receiving surface disposed on an inside surface of the shell portion and configured to interchangeably receive and thermally engage any one of a plurality of different lighting strips to customize the display device for different lighting requirements.

10. The display device of claim 9 wherein the lower rail and the upper rail comprise molded hollow polymeric members that are substantially filled with a foam insulation material.

11. The display device of claim 10 wherein the plurality of mullions include one or more mullions with a first width and one or more mullions with a second width, wherein the second width is double the first width.

12. The display device of claim 10 wherein the plurality of mullions include two or more mullions.

13. The display device of claim 10 further comprising an upper support member coupled to the upper rail and a lower support member coupled to the lower rail, and wherein the upper and lower support members provide support for the door.

14. The display device of claim 13 further comprising an LED lighting strip interchangeably coupled to an interior face of at least one of the mullions.

* * * * *